US006938958B2

(12) United States Patent
Gold et al.

(10) Patent No.: US 6,938,958 B2
(45) Date of Patent: Sep. 6, 2005

(54) ADJUSTABLE HEAD SUPPORT

(75) Inventors: Katherine Gold, Denver, CO (US); Lynn Rosen, Parker, CO (US)

(73) Assignee: Gold Bug, Inc., Denver, CO (US)

( * ) Notice: Subject to any disclaimer, the term of this patent is extended or adjusted under 35 U.S.C. 154(b) by 0 days.

(21) Appl. No.: 10/792,416

(22) Filed: Mar. 2, 2004

(65) Prior Publication Data

US 2005/0121962 A1 Jun. 9, 2005

Related U.S. Application Data

(63) Continuation-in-part of application No. 10/731,192, filed on Dec. 8, 2003.

(51) Int. Cl.[7] ..... A47C 7/38

(52) U.S. Cl. ..... 297/397; 297/393; 297/398; 297/399; 297/400; 297/404; 297/406; 297/407

(58) Field of Search ..... 297/397, 398, 297/399, 400, 393, 406, 407, 404, 216.12

(56) References Cited

U.S. PATENT DOCUMENTS

| | | | | | |
|---|---|---|---|---|---|
| 217,169 | A | * | 7/1879 | Taylor | 297/399 |
| 380,251 | A | * | 3/1888 | Dillon et al. | 297/404 X |
| 430,731 | A | * | 6/1890 | Dobson et al. | 297/398 |
| 480,822 | A | * | 8/1892 | Mayes | 297/406 X |
| 544,106 | A | * | 8/1895 | Mann | 297/407 |
| 2,464,435 | A | | 3/1949 | Conradt | |
| 2,582,571 | A | | 1/1952 | Thoma | |
| 2,613,731 | A | | 11/1952 | Roginski | |
| 2,642,124 | A | * | 6/1953 | Slowey | 297/398 |
| 2,642,927 | A | * | 6/1953 | Rising | 297/398 |
| 2,719,577 | A | * | 10/1955 | Eyman | 297/398 X |
| 2,864,433 | A | * | 12/1958 | Schnoor | 297/404 |
| 3,012,819 | A | * | 12/1961 | Mungovan | 297/399 |
| 3,062,586 | A | | 11/1962 | Rowland | |
| 3,090,648 | A | * | 5/1963 | Snyder | 297/398 |
| 3,156,500 | A | * | 11/1964 | Kerr | 297/406 X |
| 3,185,497 | A | * | 5/1965 | Lagace | 297/460 X |
| 3,205,005 | A | * | 9/1965 | Brown | 297/397 |
| 3,226,159 | A | * | 12/1965 | Binding | 297/397 |
| 3,283,344 | A | | 11/1966 | Blanchard | |
| 3,429,615 | A | * | 2/1969 | Belk | 297/397 X |
| 3,506,306 | A | * | 4/1970 | Herzer et al. | 297/397 X |
| 4,285,081 | A | * | 8/1981 | Price | 297/393 X |
| 4,440,443 | A | | 4/1984 | Nordskog | |
| 4,550,458 | A | * | 11/1985 | Fiore | 237/393 X |
| 4,738,488 | A | | 4/1988 | Camelio | |
| 4,797,934 | A | * | 1/1989 | Hufnagel | 297/398 X |

(Continued)

FOREIGN PATENT DOCUMENTS

DE 19918517 C1 5/2000

(Continued)

*Primary Examiner*—Rodney B. White
(74) *Attorney, Agent, or Firm*—Ellen Reilly

(57) ABSTRACT

A toddler head support having a unitary support member which includes a padded central support portion and padded side support portions having rounded ends. The central support portion includes a support panel which provides a support base for a wire that forms looped members on each of the side supports. The looped wire provides for adjustability of the side supports. The support member includes an elastic strap and padded wire clips for attachment to a toddler car seat or automobile head rest.

19 Claims, 4 Drawing Sheets

U.S. PATENT DOCUMENTS

| | | | | | |
|---|---|---|---|---|---|
| 5,129,705 | A | | 7/1992 | Wray | |
| 5,220,700 | A | * | 6/1993 | Liu | 297/393 X |
| 5,313,678 | A | * | 5/1994 | Redewill | 297/393 X |
| 5,505,523 | A | * | 4/1996 | Wang | 297/393 |
| 5,544,378 | A | * | 8/1996 | Chow | 297/397 X |
| 5,778,469 | A | * | 7/1998 | Festa | 297/393 X |
| 5,791,735 | A | * | 8/1998 | Helman | 297/407 |
| 5,974,607 | A | * | 11/1999 | Smith | 297/393 X |
| 6,123,389 | A | | 9/2000 | O'Connor et al. | |
| 6,139,106 | A | * | 10/2000 | Aldridge | 297/406 |
| 6,220,668 | B1 | | 4/2001 | Scheffzuck | |
| 6,305,749 | B1 | | 10/2001 | O'Connor et al. | |
| D450,517 | S | | 11/2001 | Darling et al. | |
| 6,386,639 | B1 | | 5/2002 | McMichael | |
| 6,394,544 | B1 | | 5/2002 | Bieven et al. | |
| 6,513,871 | B2 | * | 2/2003 | Bartels | 297/216.12 |
| 6,641,220 | B2 | * | 11/2003 | Clegg | 297/397 |
| 2001/0054837 | A1 | | 12/2001 | O'Connor | |
| 2002/0140262 | A1 | | 10/2002 | Ossandon et al. | |
| 2003/0137177 | A1 | * | 7/2003 | Nyman | 297/397 |
| 2003/0151279 | A1 | * | 8/2003 | Fowler | 297/216.12 |
| 2003/0178880 | A1 | * | 9/2003 | Hannah | 297/406 |
| 2004/0007910 | A1 | * | 1/2004 | Skelly | 297/406 |

FOREIGN PATENT DOCUMENTS

| | | | | | |
|---|---|---|---|---|---|
| EP | 142822 | A2 | * | 5/1985 | 297/406 |
| GB | 2155775 | A | * | 10/1985 | 297/397 |
| GB | 2246292 | A | * | 1/1992 | 297/397 |
| JP | 06225824 | A | * | 8/1994 | 297/399 |

* cited by examiner

ADJUSTABLE HEAD SUPPORT

CROSS-REFERENCE TO RELATED APPLICATIONS

This application is a continuation-in-part of patent application Ser. No. 10/731,192, filed 8 Dec., 2003 for DEFORMABLE INFANT HEAD SUPPORT by Katherine Gold et al and assigned to the assignee of this invention and incorporated by reference herein.

BACKGROUND AND FIELD OF INVENTION

This invention relates to toddler head supports; and more particularly relates to a novel and improved self-supporting, flexible but firm, toddler head and neck support.

Head supports, such as, cushions, neck pillows, inflatable head supports or head rests using wing members with a hinge mechanism are known prior art. These types of devices are typically used by adults on an airplane or in a motor vehicle and do not provide the flexibility yet firmness required for a toddler head support.

It is desirable to have a toddler head support that allows a toddler to move his neck and head about in a comfortable fashion while at the same time providing sufficient support and firmness to allow a toddler to remain in an upright or substantially upright position and to rest his head including the lower cheek and jaw area on a firm support.

There is therefore a need for a toddler head and neck support that will retain the toddler's head and neck in a desired position while providing a flexible but firm means of support that is conformable into different opening sizes according to the size of the toddler's head.

SUMMARY OF THE INVENTION

It is therefore an object of the present invention to provide for a novel and improved head support for toddlers.

It is an object of the present invention to provide for a novel and improved head support for toddlers that is easily adjustable according to the size of the toddler's head.

It is another object of the present invention to provide for a novel and improved head support for toddlers that provides adequate support for a toddler's head including the neck and chin.

It is another object of the present invention to provide a novel and improved toddler head support which is easily portable and can be used in a toddler car seat, stroller or the like.

It is a further object of the present invention to provide a novel and improved toddler head and neck support that provides adequate support for the head and neck of a sleeping toddler.

It is a final object of the present invention to provide a novel and improved toddler head and neck support that supports a toddler in an upright or substantially upright position.

In accordance with the present invention, there is provided a head support with a padded support member including a central support portion, downwardly directed side support portions at opposite ends of the central support portion and deformable wire-reinforcing means extending internally along a substantial length of the side support portions for conforming the side support portions to each side of a toddler's head. The wire-reinforcing means is attached to a flat panel contained within the central support portion and the flat panel and wire-reinforcing means are covered in a protective padding. The toddler head support preferably includes strap means to secure the device to a stationary article. The device also includes upper suspension means attached to the central support portion to suspend the device from a stationary article.

In one embodiment, the wire-reinforcing means extend from an upper portion of the flat panel and includes a looped member at each single rounded end of the side support portions and terminating at a lower portion of the flat panel.

In another embodiment, the central support portion and side support portions contain padding of uniform thickness. In a further embodiment, the side support portions include padding of greater thickness than the padding surrounding the central support portion.

The above and other objects, advantages and features of the present invention will become more readily appreciated and understood from a consideration of the following detailed description of preferred and modified forms of the present invention when taken together with the accompanying drawings in which:

DETAILED DESCRIPTION

Figure 1:
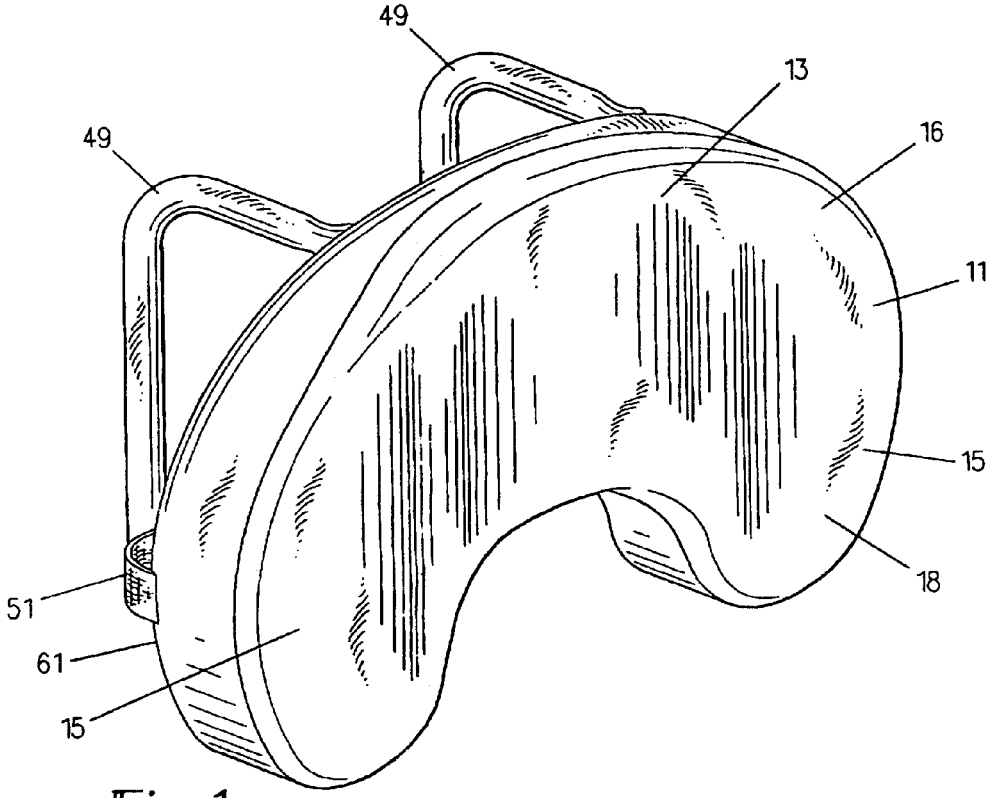
FIG. 1 is a perspective view of an embodiment of the present invention illustrating a toddler head support.
Figure 2:
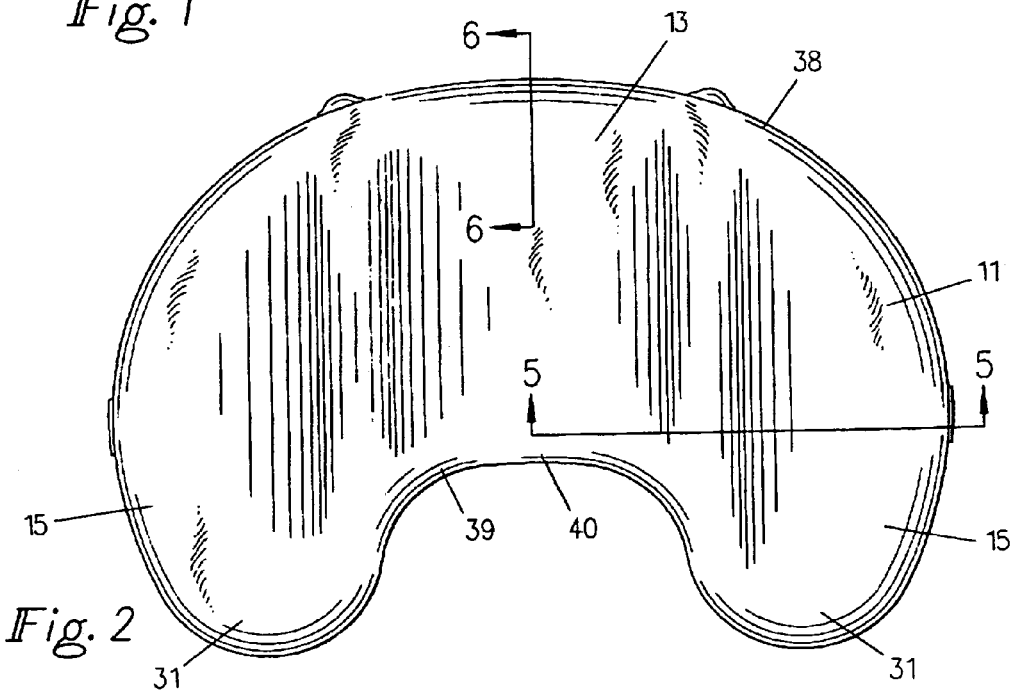
FIG. 2 is a front view of the embodiment of FIG. 1.

Referring to FIGS. 1 through 9, there is provided a toddler head support device comprising a padded support device 11 including a unitary central support portion 13 and side support portions 15 as shown in FIGS. 1 and 2. The central support portion 13 and side support portions 15 generally include a padded member 16 with an upper convex end 38 and a lower concave end 40 and downwardly directed, convergent side supports 15. The padded member 16 is completely covered with a cloth covering 18 and includes padded wire clips 49 for suspending the device 11 from an upper portion of a toddler car seat or headrest portion of an automobile. A strap 51 is attached to a lower inside portion 61 of the device 11 to further secure the device to a headrest or car seat.

Figure 4:
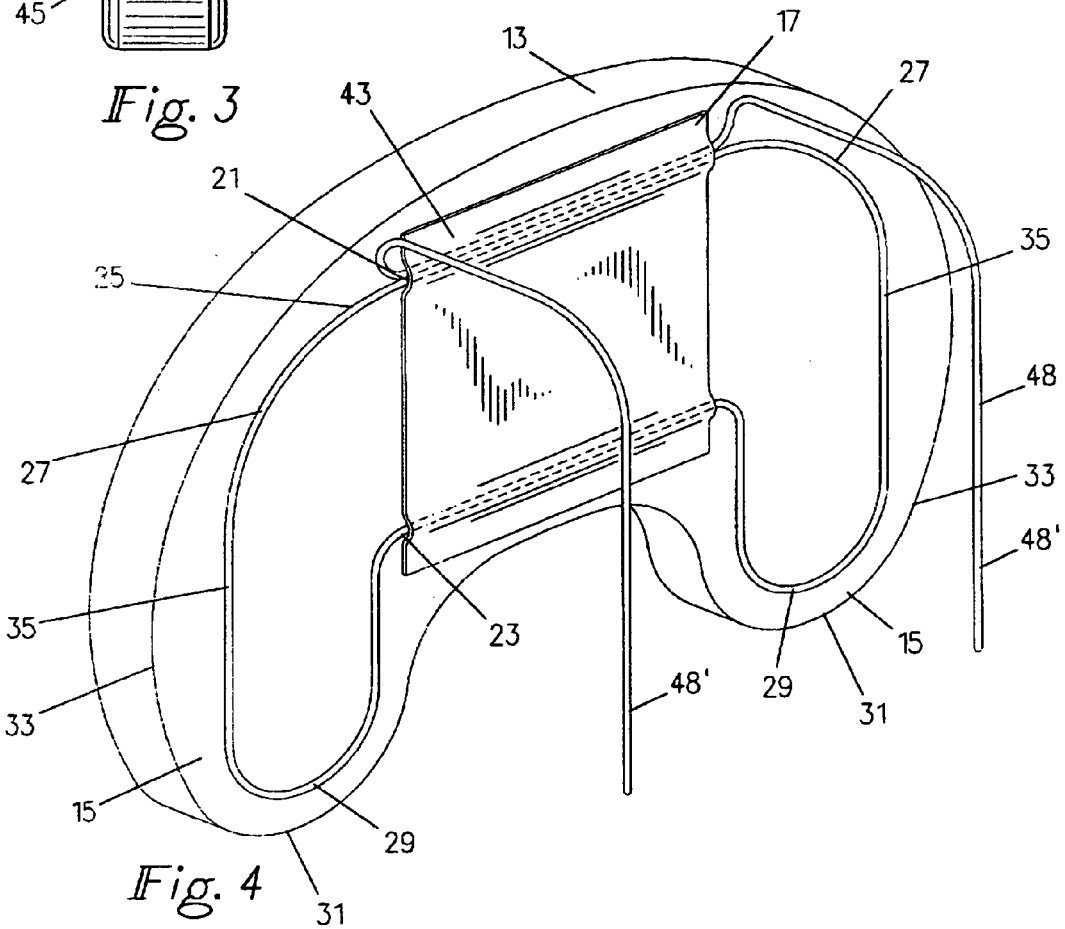
FIG. 4 is a perspective rear view with the cover removed of the embodiment of FIG. 1.
Figure 5:
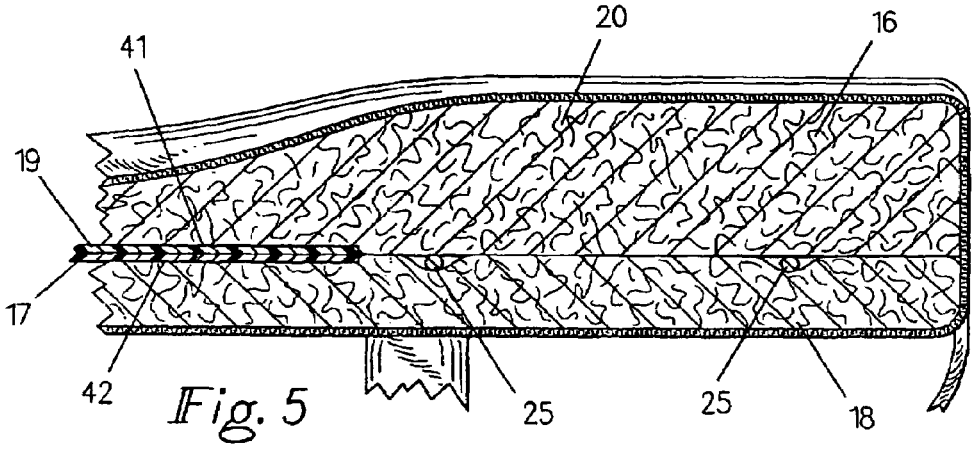
FIG. 5 is a cross-sectional view of the embodiment of FIG. 2 taken about lines 5—5.
Figure 6:
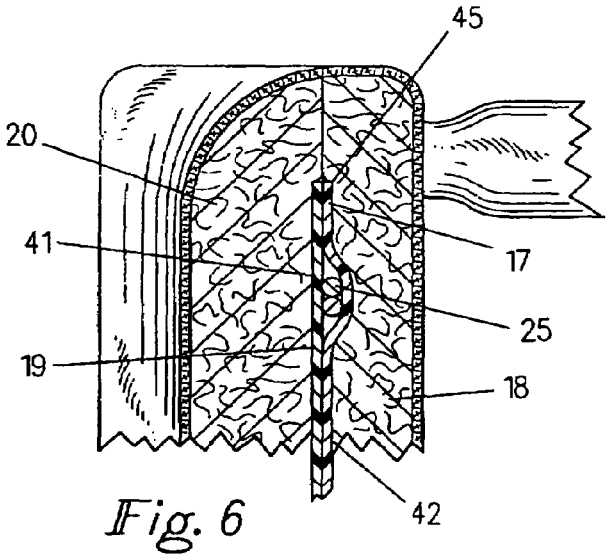
FIG. 6 is a cross-sectional view along lines 6—6 of the embodiment of FIG. 2.

The central support portion 13 includes a flat panel 17 as shown in FIGS. 4, 5 and 6, which is secured to a second flat panel 19 with wire entry passages 21 along an upper portion of the panels 17 and 19 and a lower wire entry passage 23 along a lower end of the panels 17 and 19. The flat panel 17 extends the same length as the flat panel 19 as shown in FIGS. 5 and 6. The flat panels 17 and 19 are preferably formed of a durable, semi-rigid plastic or similar type material and preferably have a square configuration. The flat panels 17 and 19 are centered within the central support portion 13 to provide a firm support for the back portion of a toddler's head. The flat panels 17 and 19 also provide a support base for a wire member 25 which extends a substantial length of side support portions 15 as shown in FIG. 4. The wire member 25 is preferably a lightweight, bendable material and extends endlessly through the upper wire entry passage 21, forming rounded edges 27 and the looped ends 29 near rounded side support ends Detailed Description 31 located at lower ends 33 of each of the side support portions 15. The rounded edges 27 and looped ends 29 of the wire member 25 provide side support for the head and neck of a toddler while also allowing for adjustability of each of the side support portions 15. The side support portions 15 are forwardly and downwardly convergent forming a protective support for a toddler's head, neck and chin. The side support portions 15 may be inwardly directed to form a firm chin support as shown in dotted form in FIGS. 8 and 9. The side support portions 15 also may be adjusted independently of one another to conform to a desired shape. If a toddler requires a wider opening on one of the side supports 15, this is possible with the wire member 25. Further, the rounded edges 27 and the looped ends 29 prevent sharp edges from coming into contact with the head or neck of a toddler thereby providing a comfortable head support. The wire member 25 forms a dual wire frame 35 on each side of the support portions 15. This provides further independent adjustability of each side of the support portions 15. The dual wire frame 35 also provides a more stable side support allowing the side support portion 15 to retain a desired shape. Once adjusted to a desired configuration, the side supports 15 will retain this desired shape until readjusted.

Figure 3:
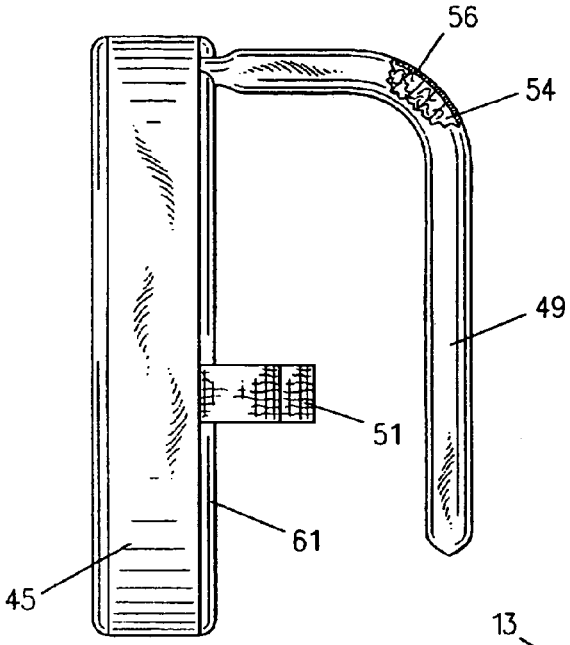
FIG. 3 is a side view of the embodiment of FIG. 1.

The padded member 16 includes a padding portion 18 and secondary padding portion 20 which are joined to form the downwardly extending side supports 15 as shown in FIGS. 2, 5 and 6 with the lower concave end 40 along a lower central portion 39. The secondary padding portion 20 is secured to a face 41 of the flat panel 19 and a side of the wire member 25. The padding portion 18 is secured to a face 42 of the flat panel 17 and shown in FIGS. 5 and 6. The padding portion 18 and the secondary padding portion 20 are joined together to form the padding member 16 with the looped wire member 25 and the flat panels 17 and 19 centered within the padding member 16. Variations of the padding combination may also be used to form a soft cushion surrounding the wire member 25. The padding member 16 forms a squared side edge 45 along the entire side support portions 16 as shown in FIGS. 3, 8 and 9.

Figure 8:
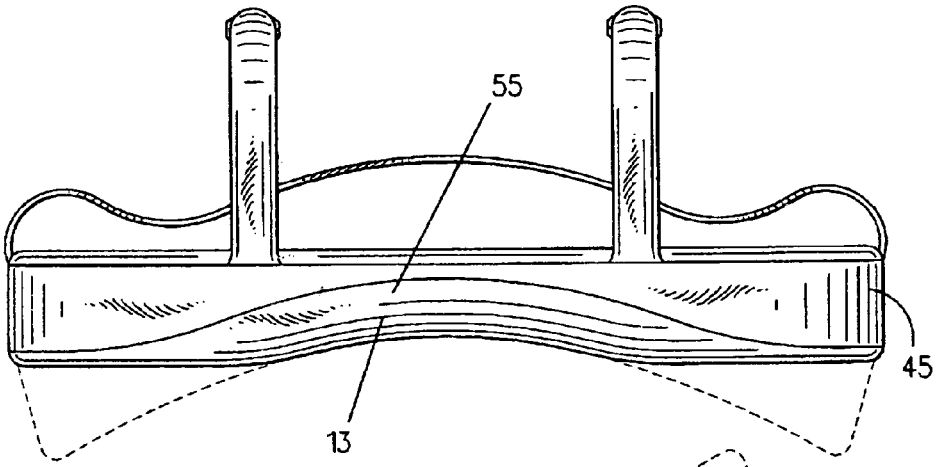
FIG. 8 is a top plan view of the embodiment of FIG. 1.
Figure 9:
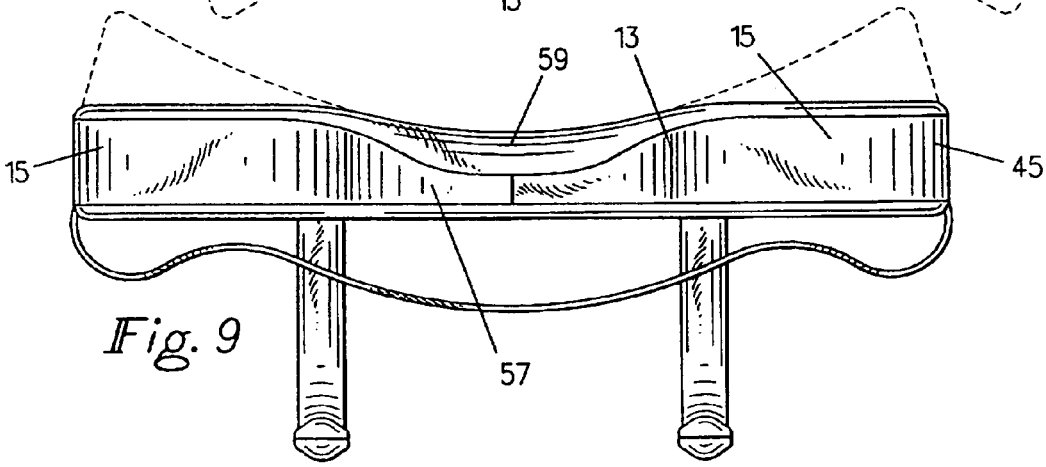
FIG. 9 is a bottom plan view of the embodiment of FIG. 1.

Referring to FIGS. 8 and 9, upper edge 55 and lower edge 57 of the central support portion 13 form a modified edge of lesser thickness than the side support portions 15. The decrease in padding aids in positioning a toddler's head into a recess 59 that is formed in the central support portion while the side support portions 13 are designed to conform around the sides of an infant's head. The side support portions 15 are capable of being pulled in to support both sides of a toddler's chin thereby providing a more comfortable sleeping position for a toddler while in a car seat. The upper convex end 38 and lower concave end 40 in combination with the downwardly convergent side supports 15 form a curved opening to receive a toddler's head and neck as shown in FIGS. 2, 8 and 9. The padding surrounding the central support portion and side support portions may also be of uniform thickness, which would not prevent adjustability of the side supports 15.

Figure 7:
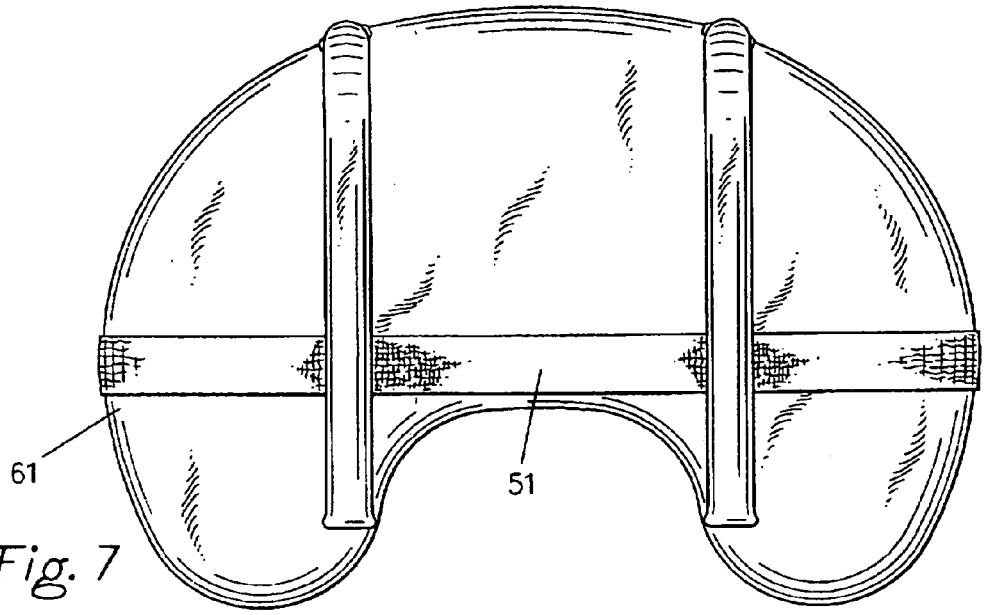
FIG. 7 is a rear view of the embodiment of FIG. 1.

The device 11 includes the padded wire clips 49 for suspending the device 11 from the upper portion of a toddler car seat or the headrest portion of an automobile. Shown in FIG. 4, the padded wire clips 49 are made up of a bendable wire 48, similar to that used in the side supports 15. The single piece of wire 48 is passed through the upper wire entry passage 21 resulting in a pair of wire members 48' extending from the upper portion 43 of the flat panels 17 and 19. The wire members 48' are completely surrounded with a foam padding 54 and then with a cloth covering material 56. The cloth material 56 is then attached, preferably sewn to the cloth covering 18 as shown in FIG. 3. Due to the nature of the attachment of the wire members 48' to the flat panels 17 and 19, the padded wire clips 49 move simultaneously with one another. The clips 49 are of adequate length to be releasably suspended from an upper portion of a toddler car seat, automobile car seat, headrest or the like. This suspension allows the toddler's head to be stabilized while allowing for adjustability of the side portions 15. Alternatively, plastic clips or similar devices may be used to suspend the device 11 from a stationary object. The strap 51 made of elastic material is secured to the rear portion of the device 11, preferably at the lower inside portions 61 of the side supports 15, to further secure the toddler headrest 11 to a stationary object. This is shown in FIGS. 3 and 7. The strap 51 may be placed around the back side of a headrest or toddler seat and provides additional stabilization of the headrest to a stationary object.

In use, the device 11 is suspended from a toddler car seat or the like with the clips 49. A toddler's head is placed in the recess 59 and the side portions 15 are adjusted to conform to a toddler's head and neck. The device 11 provides a support for a toddler in an upright or semi-upright position.

It is therefore to be understood that while preferred forms of invention are herein set forth and described, the above and other modifications may be made therein without departing from the spirit and scope of the invention as defined by the appended claims and reasonable equivalents thereof.

We claim:

1. A head support device comprising:

a padded head support member including a central support portion and adjustable downwardly directed side support portions, said side support portions adjustable to forwardly convergent positions at opposite ends of said central support portion;

a pliable reinforcing member used in manually conforming said side support portions to each side of a person's head, said reinforcing member defined by a continuous frame extending throughout said central support portion and said side support portions in inner spaced relation to outer peripheral edges of said side support portions; and upper suspension means attached to said head support member for suspending said device from a stationary object.

2. The head support device according to claim 1 wherein said central support portion includes panel means for providing a semi-rigid central support and attachment frame for said reinforcing means.

3. The head support device according to claim 2 wherein said upper suspension means are attached to said panel means.

4. The head support device according to claim 2 wherein said reinforcing member is attached to said panel means.

5. The head support device according to claim 4 wherein said panel means and said reinforcing member are attached to a plurality of padding members forming a support pillow.

6. The head support device according to claim 1 wherein said deformable reinforcing member includes a bendable wire member.

7. The head support device according to claim 1 wherein said device includes strap means whereby to secure a lower portion of said device to a stationary article.

8. The head support device according to claim 7 wherein said strap means includes a flexible elastic strap secured to opposite side portions of said device.

9. The head support device according to claim 1 wherein said upper suspension means include a pair of padded wire-reinforced clips.

10. The head support device according to claim 1 wherein each of said side support portions terminate in a single rounded end.

11. The head support device according to claim 10 wherein said reinforcing member extends from an upper portion of said central support portion and includes a looped member at each said single rounded end.

12. The head support device according to claim 1 wherein said side support portions contain padding of uniform thickness.

13. The head support device according to claim 1 wherein said central support portion contains padding of lesser thickness than said side support portions.

14. The head support device according to claim 1 wherein said central support portion and said side support portions form an upper convex end and a lower concave end.

15. A head and neck support device comprising:

a padded support member having a central padded portion and adjustable padded and downwardly directed side portions, said side portions adjustable to forwardly convergent positions;

said support member having dual pliable wire reinforcing members used in manually conforming said side portions to a user's head, said reinforcing members defined by a wire member extending from an upper portion of said central portion and forming a looped member extending downwardly at outer peripheral edges of said side support portions; and a pair of wire support clips attached to an upper portion of said support member.

16. The head and neck support device according to claim 15 wherein said support member includes a semi-rigid central support member for providing an attachment frame for said wire reinforcing means.

17. The head and neck support device according to claim 15 wherein said side portions each terminate in a single rounded end.

18. The head and neck support device according to claim 15 wherein said side portions contain padding that is of greater thickness than said central portion.

19. The head and neck support device according to claim 15 wherein said central padded portion includes an upper convex configuration and a lower concave configuration.

* * * * *

UNITED STATES PATENT AND TRADEMARK OFFICE

CERTIFICATE OF CORRECTION

PATENT NO. : 6,938,958 B2
DATED : September 6, 2005
INVENTOR(S) : Gold, K. et al.

It is certified that error appears in the above-identified patent and that said Letters Patent is hereby corrected as shown below:

Column 4,
Line 54, cancel “means” and substitute -- member --.
Line 63, cancel “deformable”.

Column 6,
Line 14, cancel “means” and substitute -- member --.

Signed and Sealed this

First Day of November, 2005

JON W. DUDAS
*Director of the United States Patent and Trademark Office*